US005855316A

United States Patent [19]

Spivey

[11] Patent Number: 5,855,316

[45] Date of Patent: Jan. 5, 1999

[54] TWO-PIECE BASKET CARRIER

[75] Inventor: Raymond Spivey, Mableton, Ga.

[73] Assignee: Riverwood International Corporation, Atlanta, Ga.

[21] Appl. No.: 908,299

[22] Filed: Aug. 7, 1997

[51] Int. Cl.[6] ..... B65D 25/04

[52] U.S. Cl. ..... 229/120.14; 229/117.14; 229/120.01; 229/164; 206/193

[58] Field of Search ..... 229/120.14, 117.14, 229/117.13, 117.16, 117.17, 120.01, 120.29, 120.18, 164; 206/139, 162, 176, 198, 193

[56] References Cited

U.S. PATENT DOCUMENTS

| | | | |
|---|---|---|---|
| 2,911,126 | 11/1959 | Hotton | 229/117.13 X |
| 4,303,153 | 12/1981 | Boulton | 206/139 X |
| 4,396,116 | 8/1983 | Stone | 206/162 |
| 4,402,400 | 9/1983 | Stout | 206/162 |
| 5,040,672 | 8/1991 | DeMaio et al. | 206/162 |
| 5,579,904 | 12/1996 | Holle, Jr. | 206/162 X |

*Primary Examiner*—Gary E. Elkins
*Assistant Examiner*—Tri M. Mai

[57] ABSTRACT

A basket-style carrier comprised of two substantially identical carrier units. Each carrier unit has a handle panel ply opposite an end panel. The carrier units are connected by adhering the handle panel plies together to form the centrally located handle panel of the carrier. Each handle panel ply has a foldably connected handle flap which is formed from an area of the associated end panel, resulting in the end panels of the carrier having a notched portion. Each carrier unit may also include partition panels and transverse dividers.

10 Claims, 4 Drawing Sheets

TWO-PIECE BASKET CARRIER

FIELD OF THE INVENTION

This invention relates to basket-style carriers for carrying articles such as beverage bottles. More particularly, it relates to a basket-style carrier designed to carry relatively large numbers of articles.

BACKGROUND OF THE INVENTION

Basket-style carriers are commonly employed to package beverage bottles. A conventional arrangement includes opposite side panels spaced from a center handle partition to form an article receiving area on each side of the handle partition. A separate cell is commonly provided for each bottle by dividers extending between the handle partition and the side panels. Normally, the carriers are fabricated from a blank which is folded and glued into collapsed carrier form, after which the collapsed carrier is erected and loaded with bottles. When designed to carry four to eight bottles, the finished package is strong and easy to carry, providing sufficient rigidity so that when picked up and carried there is no sagging or other suggestion of weakness.

Problems of rigidity arise, however, when greater numbers of bottles, for example twelve, are packaged in a carrier of conventional design. The length of the carrier must be extended to such an extent that the carrier can give an impression of flimsiness when picked up, even though it may have sufficient strength to support the load. This could be reduced somewhat by forming the carrier from thicker paperboard stock, but that would increase the cost of the carrier and still would not entirely overcome the inherent tendency of an elongated carrier to feel less than rigid when lifted and carried.

It would be highly desirable to provide a carrier capable of holding large numbers of bottles or other articles which not only is strong enough to support the load but provides a feeling of rigidity when lifted and carried.

BRIEF SUMMARY OF THE INVENTION

The article carrier of the invention can be made large enough to accommodate more than the number of articles normally packaged in a basket carrier without reducing desired levels of rigidity and strength. It is comprised of two substantially identical carrier units, each carrier unit having an end panel and an opposite handle panel ply connected to a bottom panel and opposite side panels connected to both the end panel and the handle panel. The handle panel plies of the carrier units are adhered to each other in face-to-face relationship, whereby the handle panel of the article carrier is comprised of the combined thicknesses of the handle panel ply of each carrier unit, with the side and bottom panels of each carrier unit lying in substantially the same planes as the respective side and bottom panels of the other carrier unit.

In a preferred arrangement the handle panel plies of the carrier units not only include handle openings, which are aligned in the handle panel of the article carrier, but also foldably connected handle flaps, each containing a handle opening. The handle flap of each carrier unit is folded against the associated handle panel ply and the handle opening of the flap is aligned with the handle opening of the associated handle panel ply, whereby the handle of the article carrier is comprised of four plies. In the preferred arrangement, the end panel of each carrier unit includes a cutout area from which the handle flap of the carrier unit has been formed.

Article receiving areas may be provided by including a partition panel in each carrier unit between the end panel thereof and the handle panel ply. These areas may further be divided into cells by including dividers extending from the partition panels to the end panels and the handle panel.

The carrier is quite strong and rigid, even though large numbers of heavy articles, such as twelve beverage bottles, for example, are packaged in it. The carrier is economical to produce and simple to assemble.

These and other features and aspects of the invention will be readily ascertained from the detailed description of the preferred embodiment described below.

DETAILED DESCRIPTION OF THE PREFERRED EMBODIMENT

Figure 1:
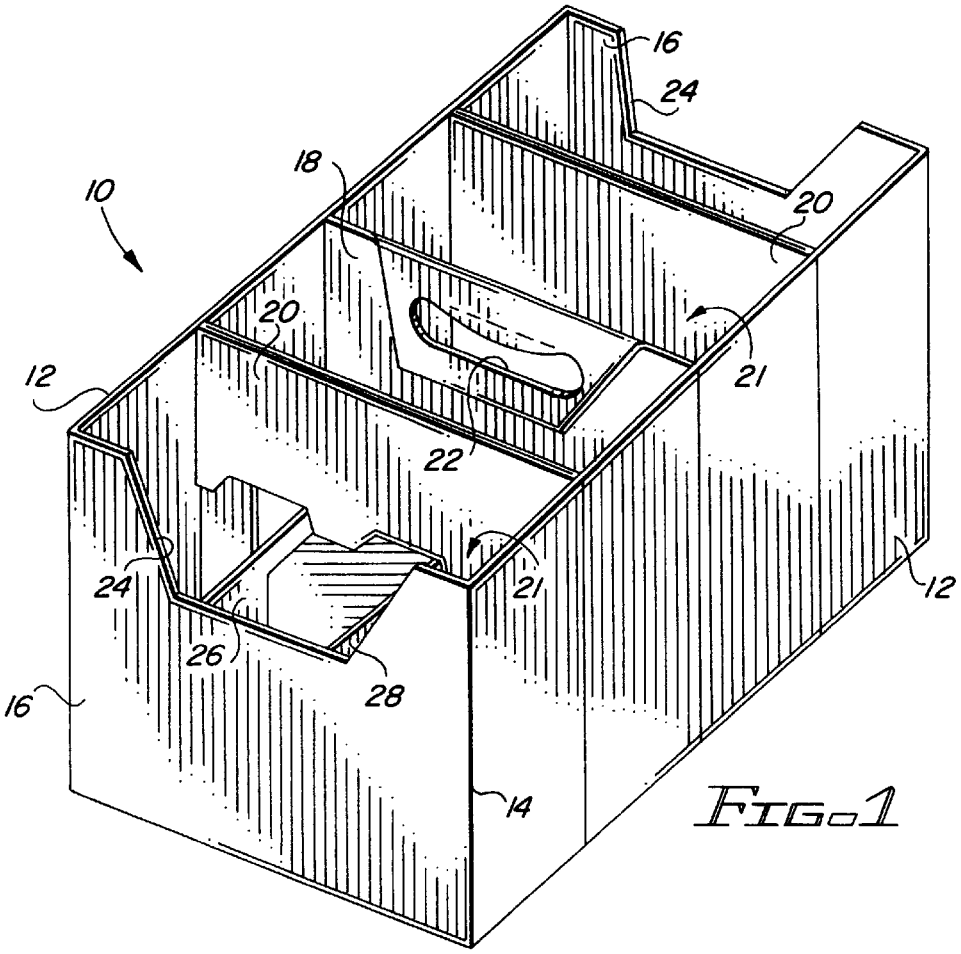
FIG. 1 is a pictorial view of a basket-style carrier incorporating the features of the invention.
Figure 2:
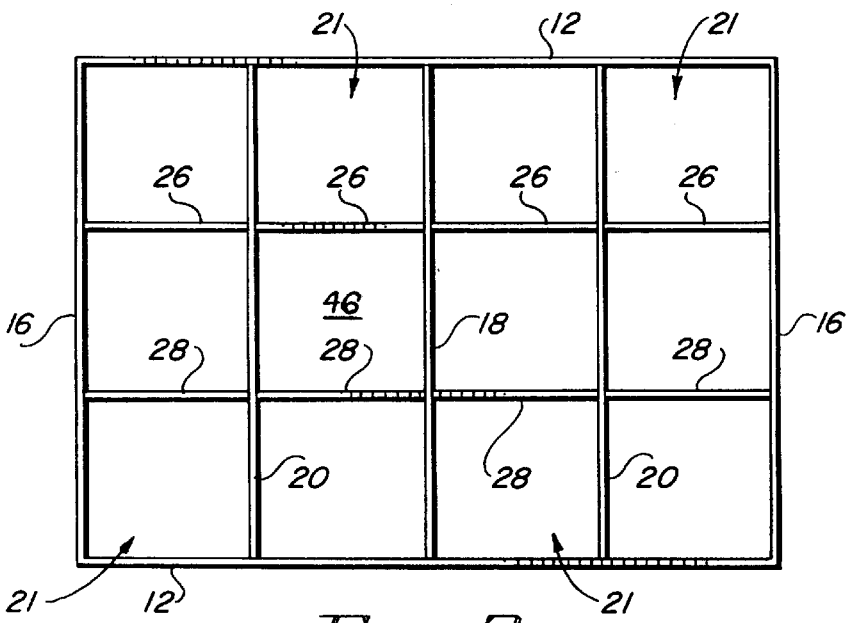
FIG. 2 is a plan view of the carrier.

Referring to FIG. 1, the basket-style carrier 10 of the invention includes opposite elongated side panels 12 connected by fold lines 14 to opposite end panels 16. Extending between the side panels are a centrally located handle panel 18 and two partition panels 20, each located midway between the handle panel 18 and the end panels 16. This arrangement forms article-receiving areas 21 on each side of the partition panels. The handle panel 18, which incorporates a handle opening 22, and the partition panels 20 are parallel to the end panels. Each end panel includes a cutout portion or notch 24 extending down from the upper edge of the end panels. In addition, individual cells in the article-receiving areas are formed by dividers 26 and 28 which extend from the partition panels 20 to the handle panel 18 and the end panels 16. As shown in FIG. 2, the illustrated arrangement incorporates two equally spaced dividers in each article-receiving area, resulting in twelve cells arranged in three rows of four cells each.

Figure 3:
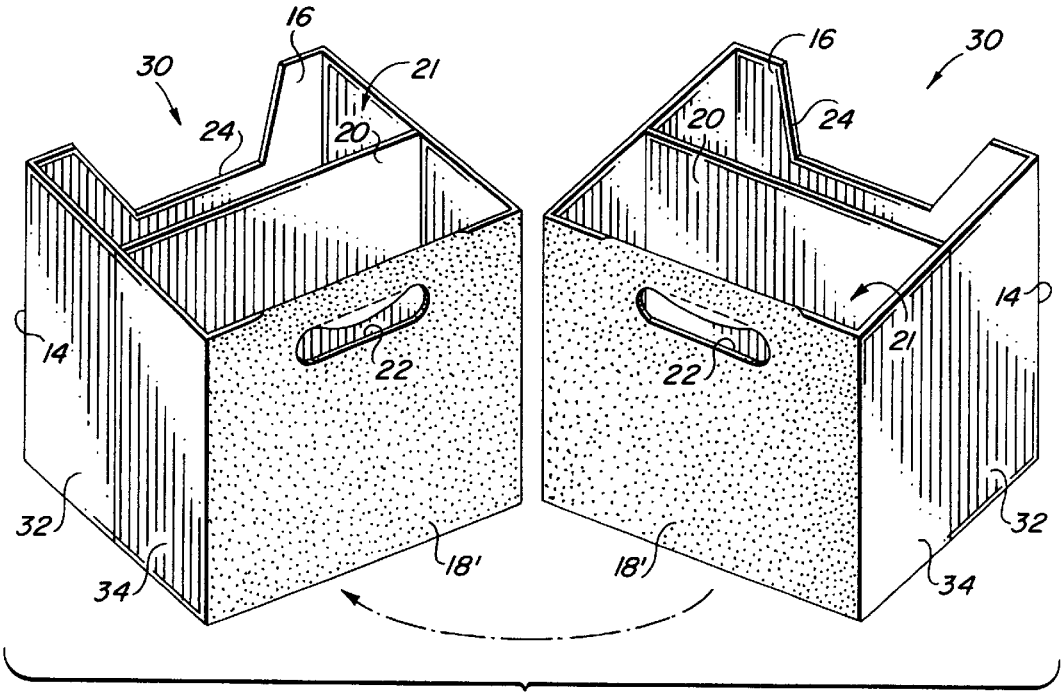
FIG. 3 is a pictorial view of two carrier units which make up a finished carrier.

Referring to FIG. 3, according to the invention the carrier 10 is formed from two identical carrier units 30, each comprised of an end panel 16 connected by side panel sections 32 and 34 to handle ply 18'. Each carrier unit 30 is shown just prior to the handle plies 18' being adhered to each other by adhesive, shown in stipple. The handle openings 22 in each handle ply are aligned in the finished carrier 10.

Figure 4:
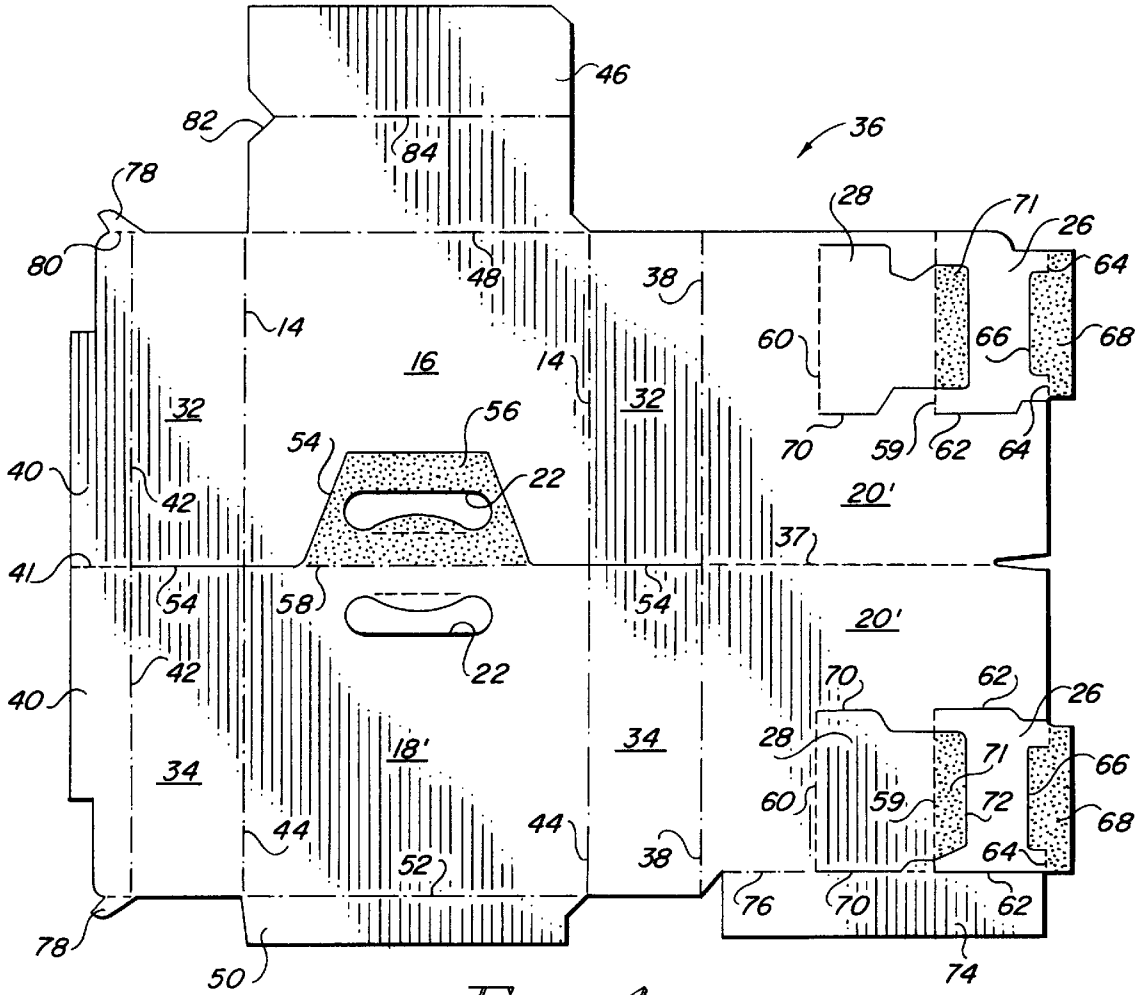
FIG. 4 is a plan view of a blank for forming a carrier unit.

Referring to FIG. 4, wherein like reference numerals to those used in FIGS. 1–3 denote like elements, a blank 36 for forming a carrier unit 30 is shown as being of generally rectangular shape except for outwardly extending flaps. Preferably, the blank is formed from paperboard of the type conventionally used in the carrier industry. At the right side of the blank a pair of partition panel plies 20' are connected to each other by fold line 37 and to one pair of side panel sections 32 and 34 by fold lines 38. At the left side of the blank a pair of riser panel flaps 40 are connected to each other by fold line 41 and to another pair of side panel sections 32 and 34 by fold lines 42. The side panel sections 32 are connected by fold lines 14 to end panel section 16, while the side panel sections 34 are connected by fold lines 44 to handle ply 18'. A bottom panel flap 46 is connected to the end panel section 16 by fold line 48, and a bottom panel glue flap 50 is connected to the handle panel ply 18' by fold line 52. The side panel sections 32 are separated from the side panel sections 34 by slit 54, which also separates the end panel section 16 from the handle ply 18'. The portion of the slit 54 separating the end panel section 16 from the handle ply 18' includes a transverse portion which forms the notch 24 in the end panel section 16. This arrangement also forms a handle panel flap 56 of the same size and shape as the notch, which is connected to the handle panel ply 18' by fold line 58. Both the handle panel ply 18' and the handle panel flap 56 contain a handle opening 22. The fold lines 37, 41 and 58 and portions of the slit 54 are aligned, as are the fold lines 14 and 44.

Each partition panel ply 20' includes divider flaps 26 and 28, which are connected to the plies by fold lines 59 and 60, respectively. The divider flap 26 in the partition panel ply connected to side panel section 34 is defined by fold line 59, slits 62, which extend from the ends of fold line 59, interrupted fold line 64 and slit 66, which extends between the interrupted portions of fold line 64. A glue flap 68 extending outwardly from the divider flap 26 is connected to the divider flap 26 by the interrupted fold line 64 and is partially defined by the slit 66. The associated divider flap 28 is defined by fold line 60, slits 70, which extend from the ends of fold line 60, and the portion of the fold line 59 between the slits 70. A glue flap 71 is formed by slit 72 and a portion of fold line 59. A similar arrangement is provided in the partition panel ply connected to side panel section 32, except that one edge of the divider flap 26 is formed by an edge of the partition panel ply and not by a slit.

A reinforcement flap 74 is connected by interrupted fold line 76 to the partition panel ply 20' connected to the side panel section 34. The fold line 76 is aligned with and interrupted by the slits 62 and 70. Also, bottom panel latching tabs 78 are connected to riser panel flaps 40 by fold lines 80, and bottom panel flap 46 includes a centrally located notch or recess 82 in the edge nearest the riser panel flaps. In addition, the bottom panel flap includes a transverse fold line 84 extending across the flap from the notch.

To form a carrier unit from the blank 36 adhesive is first applied to the handle flap 56 and the divider glue flaps 68 and 71, as shown in stipple in FIG. 4. The handle flap is then pivoted about the fold line 58 and adhered to the handle ply 18', after which the partition panel plies 20' are pivoted about the fold lines 38 and the divider glue flaps are adhered to the handle panel ply 18' and the end panel section 16. At the end of these steps, the partially folded blank appears as in FIG. 5.

Figure 5:
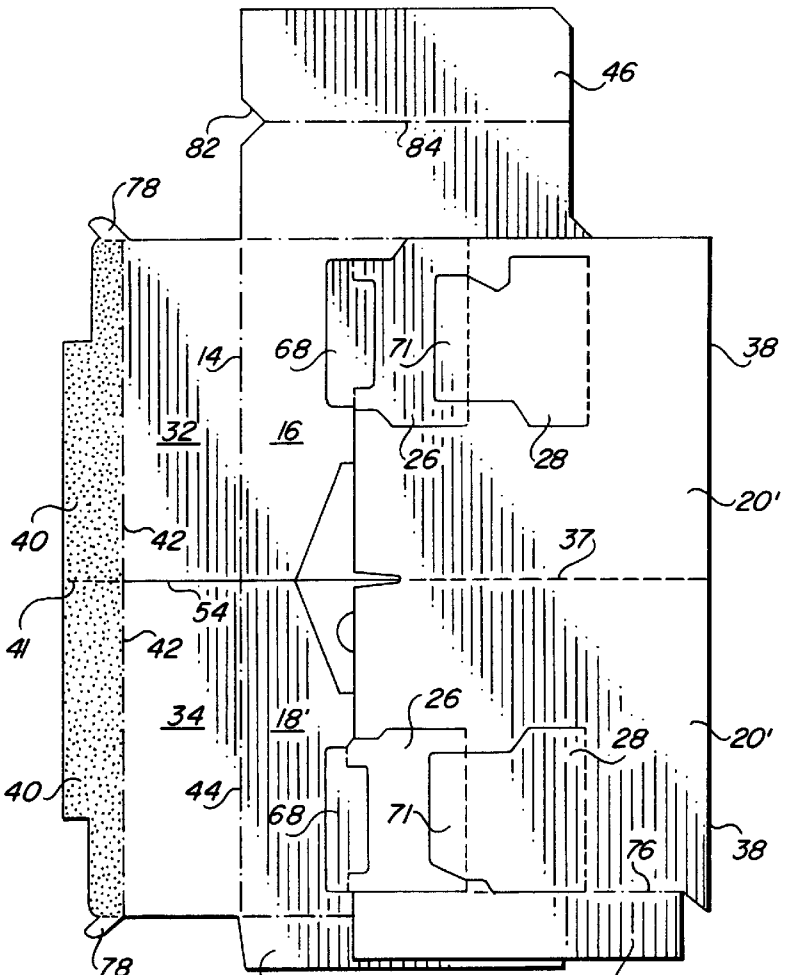
FIG. 5 is a plan view of the carrier blank after initial folding and gluing steps have been performed.

Adhesive is then applied to the riser panel flaps 40, as shown in stipple in FIG. 5. Next, the partition panel reinforcement flap 74 is first pivoted about the fold line 76 and the side panel sections 32 and 34 connected to the riser panel flaps are then folded over about fold lines 14 and 44 to bring the blank to the interim arrangement illustrated in FIG. 6. At this point the riser panel flaps are adhered to the partition panel plies 20' and the riser panel flap 40 associated with the side panel section 34 is adhered to the folded partition panel reinforcement flap 74.

Figure 7:
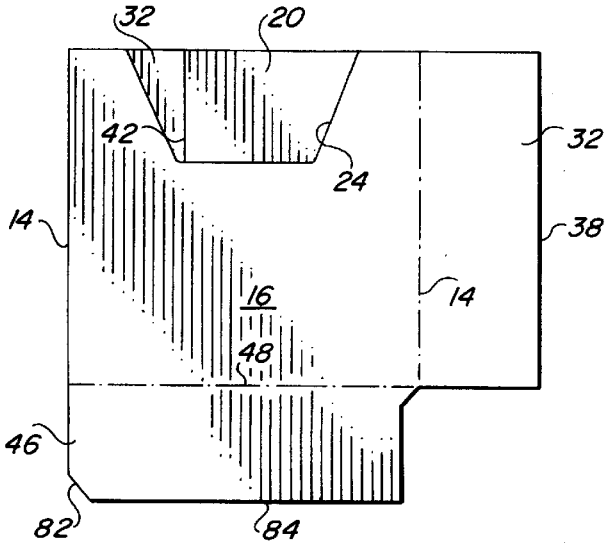
FIG. 7 is a plan view of a collapsed carrier resulting from final folding and gluing steps.
Figure 6:
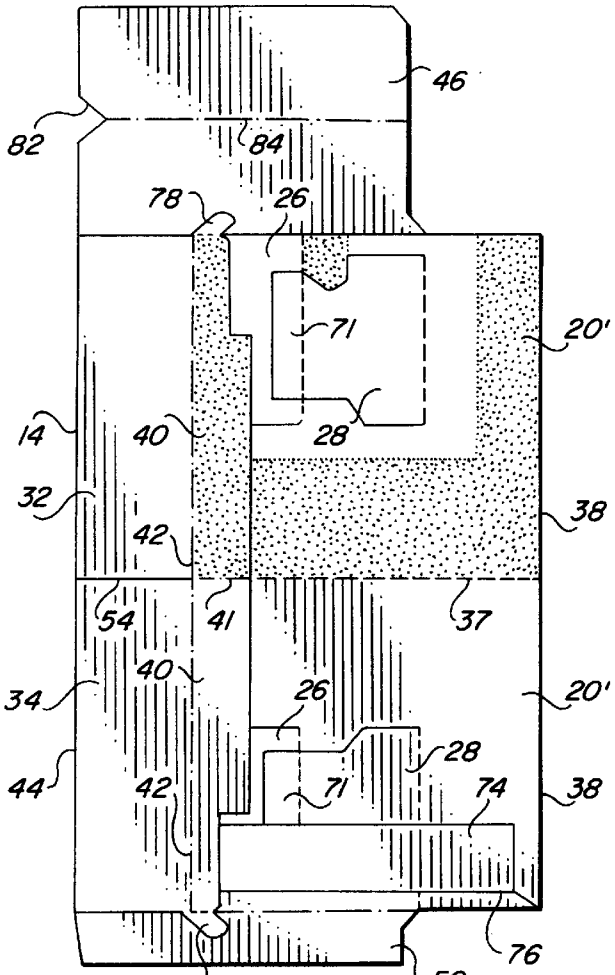
FIG. 6 is a plan view of the carrier blank after further folding and gluing steps have been performed.

The bottom panel flap 46 is then pivoted about fold line 84 and adhesive is applied to one of the riser panel flaps 40 and the associated partition panel ply, as indicated by the stippling in FIG. 6. When the blank is folded about the fold lines 41 and 37 to form the collapsed carrier half of FIG. 7, the riser panel flaps 40 are adhered together to form a two-ply riser panel, the partition panel plies 20' are adhered together to form the partition panel 20 and the reinforcement flap 74 is adhered to both the riser panel and the partition panel. The partition panel can thus be said to include the riser panel and the reinforcement flap in its structure. To complete the collapsed carrier of FIG. 7, the bottom panel flap 46 is folded about the fold line 84 and is connected to the glue flap 50 to form the bottom panel.

To form the carrier 10 of FIG. 1, two collapsed carrier units are erected by applying opposing pressure to the end fold lines 14, 44 and 38 as is well known in the art. As the folded bottom panel unfolds during this operation, the latching tabs 78 will automatically move into the notch 82 in the bottom panel to prevent the bottom panel from again collapsing. The carrier unit can freely rest on the bottom panel in this state, inasmuch as the fold lines 80 of the latching tabs permit the latching tabs to fold over between the carrier bottom and the supporting surface. The handle panel plies 18' of the erected carrier units are then coated with adhesive, as indicated by the stippling in FIG. 3, and adhered together to form the finished carrier. The handle panel plies 18' are now in the center of the finished carrier, forming the two-ply handle panel 18 of the carrier 10.

The invention permits large numbers of articles to be carried in a basket-type carrier without making the carrier an awkwardly long length. For example, in the illustrated embodiment the carrier is designed to hold twelve beverage bottles arranged so that the carrier is basically only four bottle diameters long. This arrangement, plus the two-ply handle panel and the four-ply handle area, give the carrier the strength and rigidity necessary to not only prevent sagging, but to prevent the impression of sagging as well.

The thickness of the paperboard depicted in the drawings has been exaggerated for the purpose of clarity. In actuality it would not appear as great.

It will be appreciated that the carrier units and the carrier itself are relatively simple and economical to produce and form. It will also be apparent that although the invention has been described in connection with a carrier designed for holding bottles, it applies equally to carriers designed to hold other types of articles instead. Further, it is contemplated that the invention need not necessarily be limited to all the specific details described in connection with the preferred embodiment, but that changes to certain features of the preferred embodiment which do not alter the overall basic function and concept of the invention may be made without departing from the spirit and scope of the invention defined in the appended claims.

What is claimed is:

1. A basket-style article carrier, comprising:

opposite end panels connected to a bottom panel;

opposite side panels connected to the end panels; and a centrally located handle panel extending substantially parallel to the end panels;

the article carrier being comprised of two substantially identical carrier units, each carrier unit having an end panel and an opposite handle panel ply connected to a bottom panel and opposite side panels connected to the end panel and to the handle panel;

the handle panel ply of each carrier unit being adhered to each other in face-to-face relationship, whereby the handle panel of the article carrier is comprised of the combined thicknesses of the handle panel ply of each carrier unit, the side and bottom panels of each carrier unit lying in substantially the same planes as the respective side and bottom panels of the other carrier unit, the handle panel ply of each carrier unit includes a handle opening, the handle openings being aligned in the handle panel of the article carrier and the handle panel ply of each carrier unit includes a foldably connected handle flap containing a handle opening therein, the handle flap of each carrier unit being folded against the associated handle panel ply and the handle opening of the handle flap being aligned with the handle opening of the associated handle panel ply, whereby the handle of the article carrier is comprised of four plies; and the end panel of each carrier unit includes a cutout area from which the handle flap of the carrier unit has been formed.

2. A basket-style article carrier as defined in claim 1, including a partition panel in each carrier unit between the end panel thereof and the handle panel ply thereof, the partition panel extending between the side panels of the carrier unit and being substantially parallel to the handle panel ply and the end panel.

3. A basket-style article carrier as defined in claim 2, including a plurality of dividers extending from each partition panel to the nearest end panel and to the handle panel.

4. A blank for forming a basket-style carrier unit employed in an article carrier comprised of two substantially identical carrier units, each carrier unit having an end panel and an opposite handle panel ply connected to a bottom panel and further having opposite side panels connected to the end panel and to the handle panel, the handle panel ply of each carrier unit being adhered to each other in face-to-face relationship, whereby the handle panel of the article carrier is comprised of the combined thicknesses of the handle panel ply of each carrier unit, with the side and bottom panels of each carrier unit lying in substantially the same planes as the respective side and bottom panels of the other carrier unit, comprising:

a handle panel ply and an adjacent end panel section, the handle panel ply containing a handle opening therein;

a first pair of side panel sections separated by a first slit, one of the side panel sections of the first pair being connected by a fold line to the handle panel ply and the other side panel section of the first pair being connected by a fold line to the end panel section;

a second pair of side panel sections separated by a second slit, one of the side panel sections of the second pair being connected by a fold line to the handle panel ply and the other side panel section of the second pair being connected by a fold line to the end panel section;

the handle panel ply and the end panel section being separated by a third slit;

a bottom panel flap connected to at least one of the end panel section and the handle panel ply; and means connected to one of the pairs of side panel sections for use in forming a carrier unit from the blank, the forming means including a fold line aligned with the first and second slits.

5. A blank as defined in claim 4, wherein the third slit has end portions aligned with the first and second slits and an intermediate transverse portion, the transverse portion of the third slit forming a handle flap connected to the handle panel ply by a fold line, the handle flap containing a handle opening located so as to be aligned with the handle opening in the handle panel ply in a carrier unit formed from the blank.

6. A blank as defined in claim 4, wherein the forming means is comprised of a pair of partition panel plies.

7. A blank as defined in claim 4, wherein the forming means is comprised of a pair of riser panel flaps.

8. A blank as defined in claim 4, wherein the forming means is comprised of a pair of partition panel plies connected by fold lines to one of the pairs of side panel sections and a pair of riser panel flaps connected by fold lines to the other pair of side panel sections.

9. A blank as defined in claim 8, including at least one divider foldably connected to each partition panel ply, each divider having a glue flap foldably connected thereto.

10. A blank as defined in claim 9, including a reinforcement flap foldably connected to one of the partition panel plies, the reinforcement flap being located so as to extend to the riser panel of a carrier unit formed from the blank.

* * * * *